US006001427A

United States Patent [19]

Breazeale

[11] Patent Number: 6,001,427

[45] Date of Patent: Dec. 14, 1999

[54] PROCESS FOR COATING SELECTED PORTIONS OF A SUBSTRATE USING A POWDER TRANSFER MEMBER

[76] Inventor: C. L. Breazeale, 299 N. Brandon Ct., Franklin, Ind. 46131

[21] Appl. No.: 09/103,054

[22] Filed: Jun. 23, 1998

[51] Int. Cl.[6] ..... B05D 1/28; B05D 3/02

[52] U.S. Cl. ..... 427/466; 427/428; 427/486; 427/197

[58] Field of Search ..... 427/197, 466, 427/486, 318, 375, 428, 261; 101/DIG. 37, 489, 492, 493, 211, 142; 118/211, 212, 244

[56] References Cited

U.S. PATENT DOCUMENTS 3,377,183 4/1968 Hurt, Jr. et al. .

3,765,330 10/1973 Gundlach .

4,304,179 12/1981 Katou et al. .

*Primary Examiner*—Fred J. Parker

*Attorney, Agent, or Firm*—John F. A. Earley; John F. A. Earley III; Harding, Earley, Follmer & Frailey

[57] ABSTRACT

A process for powder coating selected portions of a substrate comprises the steps of electrostatically applying a controlled thickness of a powder to an entire surface of a transfer member to form a powder coating thereon, said powder having a gel point, the temperature at which the powder turns into a gel, heating a substrate to a temperature above the gel point of the powder, pressing the heated substrate against the powder coating of the transfer member to melt the powder coating on the transfer member and cause the melted powder to stick to the substrate and coat selected portions of the substrate, and polymerizing and curing the coated portions of the substrate to fix the melted powder to the substrate.

12 Claims, No Drawings

PROCESS FOR COATING SELECTED PORTIONS OF A SUBSTRATE USING A POWDER TRANSFER MEMBER

BACKGROUND OF THE INVENTION

1. Technical Field

This invention relates to the field of powder coating selected portions of a substrate, and more particularly concerns powder coating cast aluminum valve covers for diesel engines without the necessity of masking the non-selected portions of the valve covers to prevent overspray.

2. Background of the Prior Art

Conventionally, cast aluminum valve covers are either spray painted or powder coated so that the entire cover is coated including the raised lettering or designs. Then the raised portion is sanded back to the bare aluminum to provide a contrast between the lettering and the colored background of the cover.

BRIEF SUMMARY OF THE INVENTION

The present invention is designed to overcome the problems of the prior art, and to provide a process for color coating the raised lettering of aluminum valve covers, and other substrates, but not require the laborious masking of the non-selected portions of the valve covers in order to prevent overspray.

The present invention provides a process for powder coating selected portions of a substrate, such as cast aluminum valve covers, and comprises the steps of electrostatically applying a controlled thickness of a powder to the surface of a transfer member to form a powdered coating thereon, heating a substrate to a temperature above the gel point of the powder (the gel point is the temperature at which the powder turns into a gel), pressing the heated substrate against the powder coating of the transfer member, melting the powder coating on the transfer member and causing the melted powder to stick to the substrate and coat selected portions of the substrate, and polymerizing and curing the coated portions of the substrate to fix the powder coating to the substrate.

The controlled thickness of powder is preferably a uniform thickness of approximately 4–6 mils (0.004–0.006 inches) with a uniformity of + or −1 mil.

DETAILED DESCRIPTION

The inventive process for powder coating selected portions of a substrate comprises the steps of electrostatically applying a uniform and controlled thickness of a powder to the entire surface of a transfer member to form a powder coating thereon, the powder having a gel point which is the temperature at which the powder turns into a gel, heating a substrate to a temperature above the gel point of the powder, pressing the heated substrate against the powder coating of the transfer member to melt the powder coating on the transfer member and cause the melted powder to stick to the substrate and coating selected portions of the substrate, and polymerizing and curing the coated portions of the substrate to fix the coated to the substrate.

The substrate may be a cast aluminum valve cover for diesel engines, and the selected portions of the substrate may be raised lettering thereon which is color coated to make the lettering stand out against the bare aluminum background. The inventive process produces the durability of powder coating without requiring masking of the non-coated portion of the substrate to prevent overspray.

The surface of the transfer member is cool and preferably electrically conductive when the powder is electrostatically applied to the transfer member so as to permit the most uniform application of the electrostatically applied powder. The transfer member is normally flexible, and the surface of the transfer member is smooth for coating a raised surface of a substrate or for coating a smooth surface of a substrate.

The transfer member may also be like a rubber stamp with raised letters or designs for creating letters or designs on flat or curved surfaces or raised surfaces which are only slightly raised or for coating a recessed portion of a substrate.

Shaping the transfer member also permits coating an object with varying heights of the portion to be coated.

The transfer member remains cool when the powder is being transferred to the heated substrate. After the powder transfer is made, the transfer member is cleaned prior to the application thereon of a new powder for a next substrate. Cleaning may be accomplished by blowing air onto the transfer member, or by using a vacuum to clean the transfer member before the application of a new powder for the next substrate.

Cycle times of five to ten seconds per part per machine are obtainable.

Polymerizing and curing the coated portions of the substrate may be accomplished by passing the substrate through a curing oven.

The transfer member may have a curved surface which is rolled over the substrate surface so as not to create suction and to not stir the powder which is not transferred to the substrate, thereby preventing fuzzy edges of the transferred powder.

Although originally conceived as a method of selectively coating raised surfaces of substrates, the inventive method may also be used to replace the silk-screening of decals or designs on products which have previously been powdered coated, by using a shaped transfer surface on the transfer member.

Another feature of the invention is that various colors may be applied to the same part, using multiple passes, before the part enters the curing oven. This permits designs equal to the most complex decals and these designs have the durability of the underlying powdered coated surface. If the intricacy of the designs demand it, the parts may be cured between passes so that there are overlapping layers with no gap between colors.

As to advantages of the invention, it expands the market for pure powder coatings, gives superior quality, and yields environmentally desirable benefits because no VOCs (volatile organic compounds) are used.

The powder coated transfer member may also be used to provide for powder coating substrates which are not electrically conductive, such as plastic, wood or similar substrates.

Non-conductive parts may be heated conventionally using convection or infrared ovens.

Powders are available which gel and cure at a variety of temperatures, some currently as low as 250° F. These powders would most commonly be used with heat sensitive parts.

Some low-temp cure powders are available from almost all powder manufacturers. There are also powders which are cured by ultra violet rays, instead of by the heat of a curing oven.

To further illustrate the invention, a specific example of the process follows.

Process for Powder Coating Selected Portions 24 Valve Turbo Diesel Valve Cover for a Dodge Truck I. Identification 1. Substrate identification—cast Aluminum
2. Selected Portions to be coated—All lettering, plus Ram's Head Dodge Emblem
3. Powder Used—PFR 400 S9 Red Baron by O'Brien Powder Coating.

II. Application

1. Electrostatically apply powder to a conductive padded roller. The thickness of the powder is approximately four mils. Thickness of the powder to the roller is controlled by time and powder feed from the electrostatic gun.
2. Pre-heat Valve Cover for ten (10) minutes at 275° F. A gas fired convection oven was used for this purpose. This temperature provides enough heat transfer to the part so that the part approaches the gel temperature of the selected powder.
3. The heated Valve Cover is then transferred to the machine. The machine consists of a roller, previously powder coated, that moves in a lineal direction. The Valve Cover is in a fixed position with the lettering facing down to meet the roller. The roller is then passed beneath the letters touching each letter as it passes. The powder is transferred to the letters due to the heat of the Valve Cover and the gel temperature of the powder.
4. The Valve Cover is then removed from the machine and heated to 400° F. for fifteen (15) minutes to cure the powder.

I claim:

1. A process for powder coating selected portions of a substrate using a powder transfer member, comprising the steps of electrostatically applying a uniform and controlled thickness of a powder to an entire surface of a transfer member to form a powder coating thereon, said powder having a gel point, the temperature at which the powder turns into a gel, heating a substrate to a temperature above the gel point of the powder, said substrate having selected raised portions which are to be coated with the powder, pressing only the selected raised portions of heated substrate against the powder coating of the transfer member to melt the powder coating on the transfer member and cause direct contact between the selected raised portions of the substrate and the melted powder to cause this melted powder to stick to the selected raised portions of the substrate and coat only the selected raised portions of the substrate, and polymerizing and curing the coated selected raised portions of the substrate to fix the melted powder to the substrate.

2. The process of claim 1, the selected portions of the substrate being raised lettering on a cast aluminum valve cover for diesel engines, said process producing a durable coating on the raised lettering without requiring masking the unraised portion of the substrate to prevent overspraying.

3. The process of claim 1, the surface of the transfer member being cool and electrically conductive so as to provide uniformity of the electrostatically applied powder and so as to permit a uniform application of the electrostatically applied powder onto the selected raised portions of the substrate.

4. The process of claim 1, said transfer member being flexible, and the surface of said transfer member being smooth for coating the selected raised portions of the substrate.

5. The process of claim 1, said transfer member remaining cool when the powder is being transferred to the heated substrate, and cleaning the transfer member prior to the application thereon of a new powder for a next substrate.

6. The process of claim 1, including polymerizing and curing the coated portions of the substrate by passing the substrate through a curing oven.

7. The process of claim 1, said transfer member having a curved surface, and rolling said curved surface of the transfer member over raised selected portions of the substrate so as not to create suction and not disturb the powder on the transfer member which is not transferred to the raised selected portions of the substrate and to prevent fuzzy edges of the transferred powder on the substrate.

8. The process of claim 1, including applying various colors of powder to the substrate by using multiple passes before the substrate enters a curing oven.

9. The process of claim 1, including applying a colored powder to the substrate, curing the powder on the substrate, applying powder of another color to the substrate to create an overlapping layer of color with no gap between colors, and curing the overlapping layer to fix the overlapping layer on the substrate.

10. A process for powder coating selected portions of a substrate using a powder transfer member, comprising the steps of electrostatically applying a uniform and controlled thickness of a powder to an entire surface of a transfer member to form a powder coating thereon, said powder having a gel point, the temperature at which the powder turns into a gel, heating a substrate to a temperature above the gel point of the powder, the substrate having a flat or curved smooth surface, said transfer member having raised letters or designs for creating letters or designs on the flat or curved smooth surfaces of a substrate; and contacting said powder coated transfer member and said heated substrate to cause the powder to be transferred from the raised letters or designs of the transfer member to the heated substrate.

11. The process of claim 10, said transfer member being shaped with a raised portion to fit into and coat a recessed surface of a substrate.

12. A process for powder coating selected portions of a substrate using a powder transfer member, comprising the steps of electrostatically applying a controlled thickness of a powder to an entire surface of a transfer member to form a powder coating thereon, said powder having a gel point, the temperature at which the powder turns into a gel, heating a substrate to a temperature above the gel point of the powder, said substrate having selected raised portions, pressing the selected raised portions of the heated substrate against the powder coating of the transfer member to melt the powder coating on the transfer member and cause direct contact between the selected raised portions of the substrate and the melted powder to cause the melted powder to stick to the selected raised portions of the substrate and coat the selected raised portions of the substrate, and polymerizing and curing the coated selected raised portions of the substrate to fix the melted powder to the substrate, the surface of the transfer member being cool and electrically conductive when the powder is electrostatically applied thereto so as to permit uniform application of electrostatically applied powder, said transfer member being flexible, the surface of said transfer member being smooth for coating the selected raised portions of the substrate, said transfer member remaining cool when the powder is being transferred to the heated substrate, polymerizing and curing the coated portions of the substrate by passing the substrate through a curing oven, said transfer member having a curved surface, rolling said curved surface of the transfer member over selected raised portions of the substrate so as not to create suction and not disturb the powder on the transfer member which is not transferred to the raised selected portions of the substrate and to prevent fuzzy edges of the transferred powder on the substrate, and cleaning the transfer member prior to the application thereon of a new powder for a next substrate.

* * * * *